US006725927B2

(12) United States Patent
Ohmer

(10) Patent No.: US 6,725,927 B2
(45) Date of Patent: Apr. 27, 2004

(54) METHOD AND SYSTEM FOR AVOIDING DAMAGE TO BEHIND-CASING STRUCTURES

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 94 days.

(21) Appl. No.: 10/082,469

(22) Filed: Feb. 25, 2002

(65) Prior Publication Data

US 2003/0159826 A1 Aug. 28, 2003

(51) Int. Cl.[7] ..... E21B 47/09; E21B 29/06

(52) U.S. Cl. ..... 166/255.1; 166/255.2; 166/297; 166/55.7

(58) Field of Search ..... 166/255.1, 255.2, 166/250.01, 254.1, 380, 54.5, 54.6, 55.7, 297

(56) References Cited

U.S. PATENT DOCUMENTS 5,370,545 A * 12/1994 Laurent ..... 439/190
5,458,209 A 10/1995 Hayes et al.
5,996,711 A 12/1999 Ohmer
6,012,527 A 1/2000 Nitis et al.
6,089,319 A * 7/2000 Singleton ..... 166/298
6,173,773 B1 * 1/2001 Almaguer et al. ..... 166/255.2
6,209,645 B1 4/2001 Ohmer
6,333,700 B1 * 12/2001 Thomeer et al. ..... 340/854.8
6,378,607 B1 * 4/2002 Ryan et al. ..... 166/255.2

* cited by examiner

*Primary Examiner*—David Bagnell
*Assistant Examiner*—Giovanna Collins
(74) *Attorney, Agent, or Firm*—Trop, Pruner & Hu P.C.; Jeffrey E. Griffin; Brigitte Jeffery Echds

(57) ABSTRACT

A structure is positioned on the outer surface of a casing or liner to enable cutting the casing in substantially any azimuth over a given length of casing without damaging the structure. After placing the casing in a wellbore, the position of the structure on the casing may be determined with reference to an orienting slot in an indexing coupling. Thereafter, a non-colliding region on the casing may be identified for cutting the casing.

25 Claims, 4 Drawing Sheets

METHOD AND SYSTEM FOR AVOIDING DAMAGE TO BEHIND-CASING STRUCTURES

TECHNICAL FIELD

The invention relates generally to wells for the production of petroleum products and specifically to methods and systems for avoiding damage to behind-casing structures.

BACKGROUND

Wells for the production of petroleum products are drilled through the earth's subsurface. Thereafter, a well may be lined with a casing and/or other liner and cemented to permanently fix the casing in the wellbore. The casing and/or liner that lines the wellbore is typically made from a plurality of sections that are coupled together by any suitable means, such as by threaded connections.

Downhole equipment for monitoring the production of hydrocarbons in a well or for monitoring the displacement of fluids in the surrounding formation may be permanently installed in the well. Cables for power and/or signal transmission usually connect the downhole equipment with equipment at the earth's surface. In some cases, the cabling may be positioned on the outer surface of the casing. In other cases, the cabling may simply lie between the casing and the wellbore wall. In either case, once cementing occurs, the cabling and the downhole equipment will be permanently fixed in the well.

At some point during the life of a well, it may be desired to change the trajectory of the well after the casing has been cemented into place. Moreover, it may be desired to drill and complete one or more lateral branches after the casing has been set in place. Horizontal or lateral wellbores are desirable because they maximize the wellbore's presence in a productive part of a formation. Thus, lateral branches are advantageous in that they may increase the production of petroleum products from a parent well. Accordingly, one or more lateral wellbores may be drilled at various depths along the parent well. If one or more lateral wellbores are planned for a particular well, casing string installation may be complicated by the need to orient the casing in a desired azimuth for drilling or milling while avoiding an azimuth that will sever the cabling that is positioned behind the casing.

Requiring that the casing be oriented during assembly to ensure that a lateral branch can be drilled at an azimuth that does not interfere with the behind-casing cabling increases the cost associated with installing the casing.

SUMMARY

In general, according to one embodiment, the location of a structure behind a casing in a wellbore is determined with respect to an element inside the casing. Thereafter, a position on the casing that is away from the area proximate the location of the structure is identified. An opening may then be cut in the casing at the position to avoid damaging the structure.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
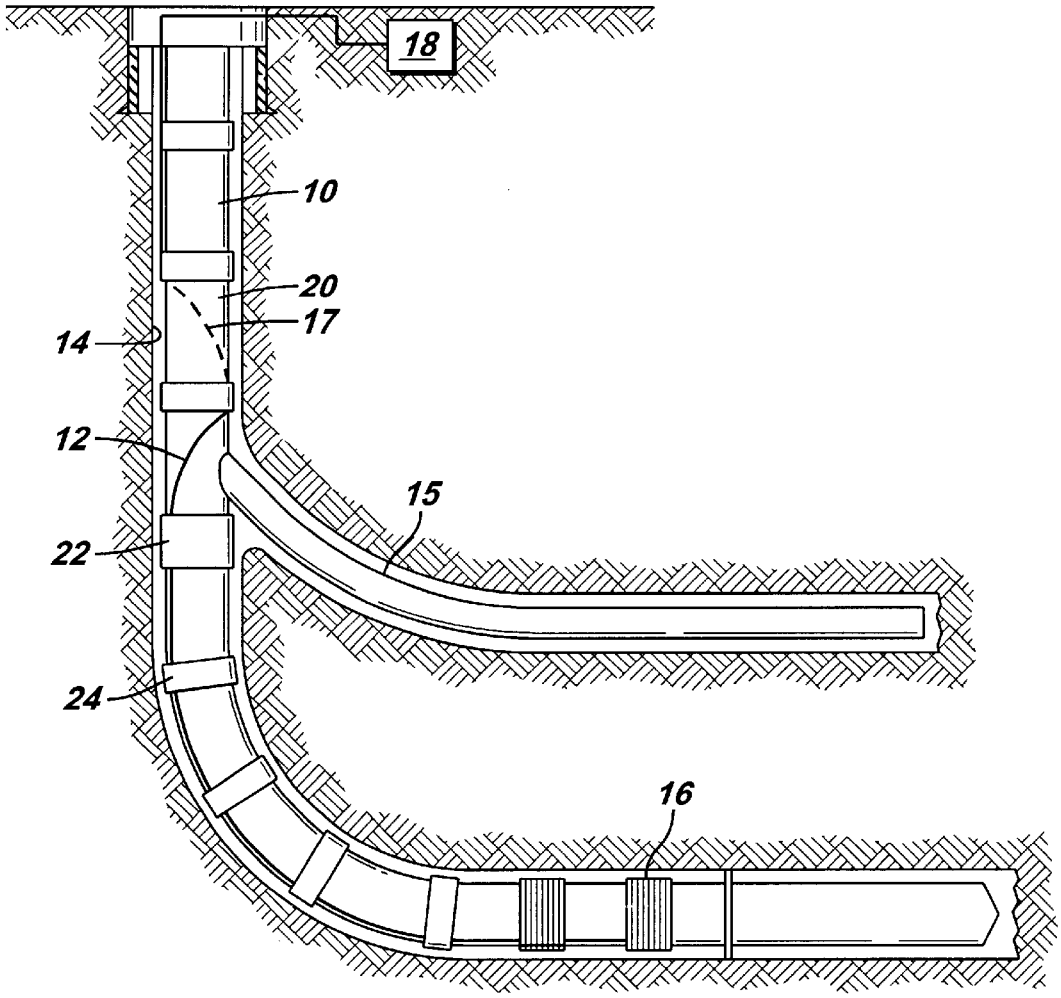
FIG. 1 illustrates the positioning of a behind-casing cabling according to one embodiment of the present invention.

As shown in FIG. 1, a casing or liner 10 having a cabling 12 installed on the casing's 10 outer surface may line a wellbore 14, according to some embodiments of the present invention. The cabling 12 connects a downhole device 16 with equipment 18 at the earth's surface. The connection between the device 16 and the equipment 18 must be maintained for as long as information from the device 16 and/or power to the device 16 are needed, presumably for the life of the well. Thus, the cabling 12 may be installed on the outer surface of the casing 10 in a predetermined path to avoid being severed during downhole operations. Specifically, the path of the cabling 12 enables drilling one or more lateral branches 15 in substantially any azimuth for a length of casing 10 without severing the cabling 12.

Azimuth may be defined as bearing in the horizontal plane, usually expressed as an angle, which may be measured clockwise from true north, grid north, or magnetic north, from 0° to 360°. As used here, the term "azimuth" is intended to mean the angular direction measured with respect to a reference, such as the earth's gravity, and in a direction that is transverse to the indicated wellbore, be it vertical, horizontal or deviated.

As used here, "casing" and "liner" are used interchangeably to refer to a casing, liner or any other downhole structure that is insertable into a wellbore to provide a flow path to the well surface. The casing 10 may be made from a plurality of sections 20 of conventional casing pipe. Likewise, the cabling 12 may be conventional cabling or any other communications line (e.g., optical fiber, hydraulic line, fluid pressure line, control line, and so forth) used to connect the downhole device 16 with the equipment 18 at the earth's surface. The downhole device 16 may be any type of equipment for performing various tasks in a well, including a sensor, monitor, electrode, measuring device, or control device and the like. The surface equipment 18 may include equipment that sends and/or receives data to and/or from the downhole equipment 16. Alternatively, the surface equipment 18 may provide power to the downhole equipment 16.

Mechanical couplings 22 and 24 are used to connect adjacent segments 20 of the parent casing 10. In one embodiment of the invention, there are at least two types of mechanical couplings, an indexing coupling 22 and an intermediate coupling 24. The indexing coupling 22, also known as an indexing nipple or a casing nipple, may be of the type described in U.S. Pat. Nos. 5,996,711 and 6,012,527, both incorporated herein by reference. The indexing coupling has orienting elements that are designed to orient an intervention tool in a predetermined position for azimuth-specific operations. Thus, the indexing coupling 22 is used to join casing segments 20 that will be at a depth in the wellbore 14 where downhole operations, such as drilling a lateral branch, are planned. In the example of FIG. 1 the indexing coupling 22 is used in the vicinity of a planned lateral branch 15. The indexing coupling 22 joins the casing segment 20 through which the lateral branch 15 is to be formed and the casing segment 20 just below the lateral branch 15. Accordingly, in a multilateral well, at each depth where a lateral branch is planned, the indexing couplings 22 connect adjacent casing segments 20. Intermediate couplings 24 connect casing segments 20 that are not otherwise joined by the indexing couplings 22.

Figure 2:
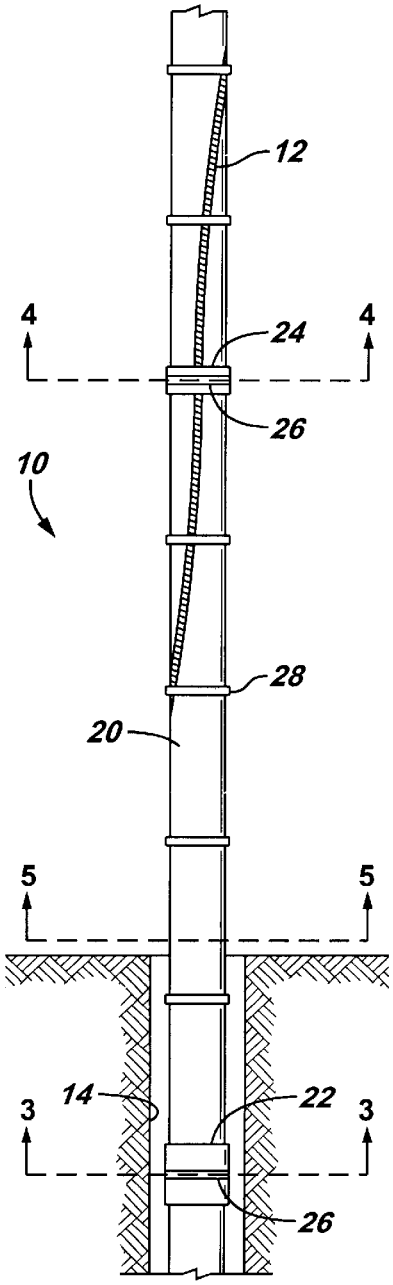
FIG. 2 illustrates the positioning of a behind-casing cabling according to another embodiment of the present invention.

As shown in FIGS. 1 and 2, the cabling 12 is installed along the outer surface of the casing 10 to follow a path that winds around an axial axis of the casing 10. The cabling 12 is also said to be "behind" the casing 10 as opposed to being inside the casing 10. The winding path of the cabling 12 results in certain portions of the cabling 12 being deviated or angled with respect to the axial axis of the casing 10. The dashed line 17 (FIG. 1) represents a portion of the cabling 12 that is hidden by the casing 10. In some embodiments, the path of the cabling 12 is generally helical. "Generally helical" refers to the overall path of the cabling that does not account for deviations due to surface irregularity or irregularity that results from attachment of the cabling 12 to the casing.

In one embodiment, the cabling 12 follows a generally helical path along substantially the entire length of the casing 10. In an alternate embodiment, the cabling 12 follows a generally helical path only in the region or regions where lateral branches or other well operations that require cutting through the casing 10 are planned. In either case, the angled portions of the cabling 12 is particularly useful when the cabling 12 is positioned on the casing section 20 or sections 20 in the proximity of the indexing coupling 22 that marks the location of a prospective lateral branch.

Figure 3:
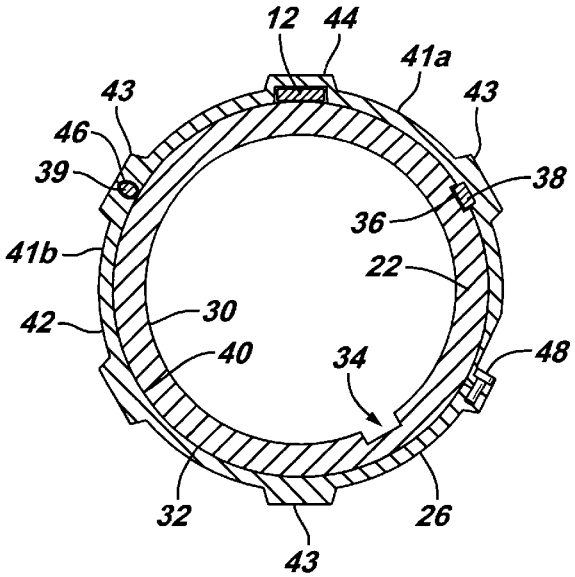
FIG. 3 is a cross-sectional view of behind-casing cabling clamped to an indexing coupling according to the embodiment FIG. 2.
Figure 4:
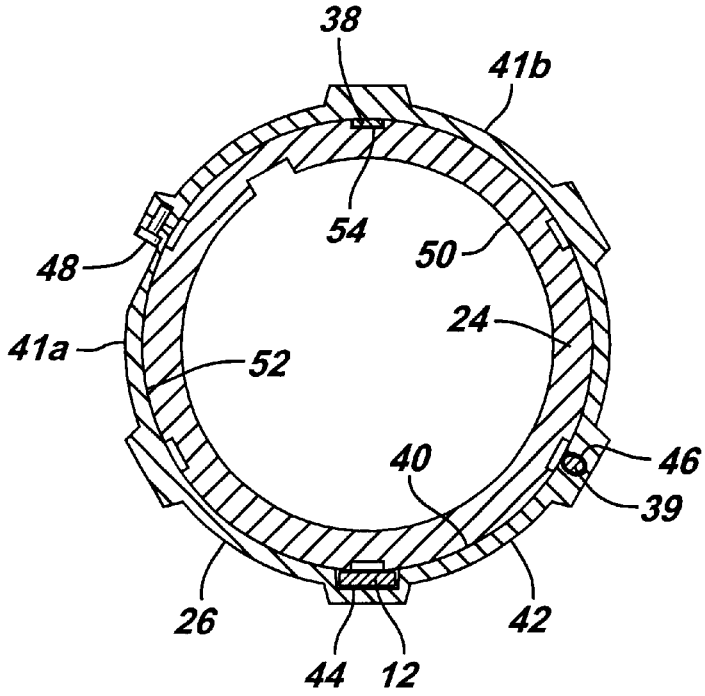
FIG. 4 is a cross-sectional view of behind-casing cabling clamped to an intermediate coupling according to the embodiment of FIG. 2.
Figure 5:
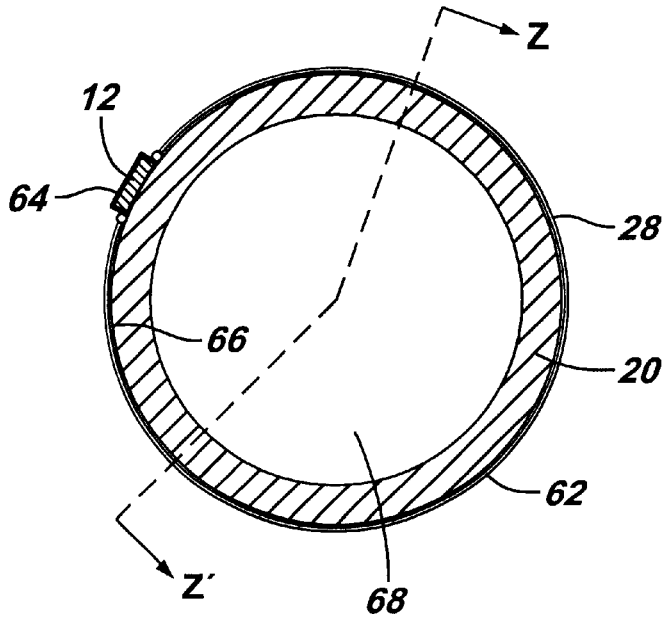
FIG. 5 is a cross-sectional view of behind-casing cabling clamped to a section of casing according to the embodiment of FIG. 2.

As shown in FIG. 2, the cabling 12 may be physically attached to the casing 10 by one of two types of clamps 26 and 28. In some embodiments, the cabling 12 is attached to the couplings 22 and 24 by a protective clamp 26, as shown in FIGS. 3 and 4 (described below). The clamps 26 are placed around the intermediate couplings 24 and the indexing couplings 22 to attach the cabling 12 to the couplings 22 and 24. In other embodiments, in addition to the clamps 26, a second type of clamp 28 (as shown in FIG. 5) secures the cabling 12 directly to the casing 10. The path of the cabling 12 is established and maintained by attaching the cabling 12 to the casing 10 with the clamps 26 and/or 28. Once the cabling 12 is attached to the casing 10 and/or couplings 22 and 24 in its predetermined path, the casing 10 may be lowered into the borehole 14 without further consideration of the orientation of the casing 10 or cabling 12 along the main axis of the wellbore 14. Thereafter, the casing 10 may be cemented to permanently fix the casing 10 and cabling 12 in place. In other embodiments, instead of or in addition to the cabling 12, other structures can also be positioned behind the casing 10. Such other structures include sensing and control devices, hydraulic lines, control lines, and so forth.

As shown in FIG. 3, the indexing coupling 22 has an interior wall 30 and an exterior wall 32. The interior wall 30 typically has an internal geometric profile for recognition by one or more selected well tools. For example, the internal profile may have a unique pattern of lands, grooves, slots and the like. Thus, the unique internal profile of the indexing coupling 22 allows for recognition of a well tool having a complementary profile.

The indexing coupling 22 may also have an orienting profile such as an orienting slot 34. The orienting slot 34 orients a well tool (not shown) that is complementary to the indexing coupling 22. Thus, when the well tool encounters the indexing coupling 22 having a complementary profile, the orienting profile of the tool engages the orienting slot 34 to orient the well tool in the desired azimuth. However, if the tool and the coupling 22 do not have matching profiles, the tool will pass through the coupling 22 until it encounters a complementary indexing coupling 22.

One or more of the index coupling's 22 specific geometrical features, such as the orientation slot 34, may be utilized to determine the coupling's 22 position and orientation in the wellbore 14. The position and orientation of the indexing coupling 22 of the type used herein may be determined as described in U.S. Pat. No. 5,996,711, which describes the use of a logging sonde having an ultrasonic scanning system to create an acoustic image of the internal profile of the indexing coupling 22. The system provides logging signals that are processed to accurately determine the orientation of the indexing coupling 22, including the azimuth of the orienting slot 34 in the coupling 22. The azimuthal orientation of the indexing coupling 22 is measured with respect to a gravity reference or to an earth magnetic reference (e.g., magnetic north). Thus, as a result of the above method and system, the specific orientation of the casing 10 does not have to be controlled during casing 10 string assembly and cementing. However, when lowering the casing 10 into the wellbore 14, it is desirable to control the depth at which the indexing couplings 22 are positioned to ensure that the couplings 22 are at an appropriate depth for future downhole operations.

The above described method and system can also detect the presence of cabling 12 outside the casing 10. For example, a portion of the acoustic waves from the scanner propagates through the casing 10 to the space between the casing 10 and wellbore 14 wall. Reflected waves may then be used to analyze various features external to the casing 10 such as the cabling 12 attached to the exterior wall of the casing 10. Therefore, the incorporated method and system are useful in directly determining the location and position of the cabling 12 if it were not otherwise known.

The exterior wall 32 of the indexing coupling 22 has a slot 36 for placement of a locating pin 38. Generally, the locating pin 38 may be utilized to align and orient the clamp 26 with respect to the coupling 22.

The clamp 26 encircles the outside of the indexing coupling 22 to secure the cabling 12 in a predetermined position. In other words, the cabling 12 is substantially fixed on the coupling 22 via the clamp 26. The clamp 26 has an inner 40 and outer 42 surface. The inner surface 40 has a duct 44 to receive the cabling 12 on the coupling 22. When clamped in place, the duct 44 ensures that the cabling 12 is in a positive orientation and prevents the cabling 12 from shifting during casing 10 string placement and cementing procedures. Note that the position of the clamp 26 with respect to the coupling 22 is fixed by the locating pin 38. The outer surface 42 of the clamp 26 may have radial projections 43 for ease of handling and manipulation. The clamp 26 may be made from cast carbon steel, or any other suitable material.

In one embodiment, the clamp 26 has two arms 41*a* and 41*b* that are joined by a hinge pin 39 situated in a bore 46. On the opposite side, the two arms 41*a* and 41*b* of the hinged clamp 26 are fastened together by a bolt 48 or by some other suitable mechanism. Alternately, the clamp 26 may have any other configuration that enables placement of the clamp 26 around the coupling 22. The clamp 26 attaches the cabling 12 to the coupling 22 in a predetermined orientation that is consistent with the cabling's predetermined path.

As shown in FIG. 4, the intermediate coupling 24 of the present invention has an interior wall 50 and an exterior wall 52. In contrast to the indexing coupling 22, the intermediate coupling 24 does not have an internal profile designed to engage a matching profile of a well tool. That is, the interior wall 50 of the intermediate coupling 24 is typically substantially smooth in that there are no features designed for well tool recognition. However, like the indexing coupling 22, the intermediate coupling 24 has one or more slots 54 for placement of a locating pin 38 on its external surface 52.

The clamp 26 that secures the cabling 12 to the intermediate coupling 24 may be the same as or substantially similar to the clamp 26 used at the indexing coupling 22. For example, the clamp 26 has a duct 44 in its inner wall 40 for positioning and protecting the cabling 12. Further, the clamp 26 may have two arms 41*a* and 41*b* that are coupled by a hinge pin 39 situated in a bore 46. Moreover, the clamp 26 may have a bolt 48 to secure the clamp 26 in a fixed position around the intermediate coupling 24. The positioning of the cabling 12 on the intermediate coupling 24 is generally the same as described for the indexing coupling 22. However, the cabling's orientation on the intermediate coupling 24 may be known with respect to the locating pin 38 and/or with respect to a nearby indexing coupling 22.

In sum, the cabling 12 may be clamped to the couplings 22 and 24 to position the cabling 12 in a predetermined helical path. As the casing 10 is assembled and installed into the wellbore, the cabling 12 is clamped to the couplings 22 or 24 at predetermined orientations to achieve the desired cabling path (e.g., helical path). Thus, at a first coupling 22 or 24, the cabling 12 is clamped at a first azimuthal position; at the next coupling 22 or 24, the cabling is clamped at a second azimuthal position; and so forth.

As shown in FIGS. 2, 3 and 4, in one example, the cabling's path is such that its orientation on the casing 10 has rotated 180° as the cabling 12 descends from the intermediate coupling 24 to the indexing coupling 22. If this path continues, the cabling 12 will rotate another 180° as it descends from the indexing coupling 22 to the coupling 22 or 24 just below (not shown). Accordingly, pursuant to this embodiment, the cabling 12 has turned 360° over the course of two adjacent casing segments 20.

The orientation of the cabling 12 may be recorded during casing 10 string construction. In particular, the cabling 12 may be clamped to the indexing coupling 22 in known orientations. For example, the indexing coupling's orienting slot 34 may serve as a reference. Thus, the cabling 12 may be positioned on the coupling 22 with a known relationship to the slot 34. The position of the orienting slot 34 may be determined as described in U.S. Pat. No. 5,996,711.

Likewise, the cabling 12 may be clamped to the intermediate coupling 24 immediately above the indexing coupling 22 in an orientation that is known relative to the clamp point on the indexing coupling 22. For example, the cabling 12 may be clamped to the intermediate coupling 24 so that the cabling's path has rotated by a predetermined angle over one casing section 20. Thus, when the clamp points on the indexing 22 and intermediate couplings 24 are known and the turn angle is also known, the position of the cabling 12 may be determined at any point relative to the orienting slot 34 of the indexing coupling 22. Accordingly, at least one lateral branch may be formed from the casing segment 20 in the proximity of an indexing coupling 22 at a desired azimuth regardless of the orientation of the casing 10 in the borehole 14. Consequently, one or more windows may be milled in the casing 10 so as to avoid cutting the cabling 12. Once the window is milled in the casing 10, drilling equipment may exit the window to drill the lateral wellbore.

Referring back to FIG. 2, a casing clamp 28 may be utilized to attach the cabling 12 to a casing segment 20 along the cabling's 12 predetermined path. Generally, the casing clamp 28 encircles the casing 10 to hold the cabling 12 in a substantially fixed position. Thus, a plurality of casing clamps 28 may clamp the cabling 12 to the casing 10 in its predetermined path as the cabling 12 winds from one coupling 22 or 24 to the next coupling 22 or 24.

In this embodiment, the clamps 28 are spaced along the length of each casing section 20. Clamping the cabling 12 directly to the casing 10 prevents the cabling 12 from deviating from the preferred path between the couplings 22 and/or 24. Thus, the casing clamps 28 help to ensure that the cabling 12 remains on its path during casing string assembly and cementing operations. Once the casing is cemented, however, the cabling 12 is permanently fixed in place. Thus, the clamps 28 may be severed during milling and/or drilling operations without affecting the position of the cabling 12. In other words, once cementing has taken place, the cement and not the clamps 28 maintain the position of the cabling 12. Thus, the fact that one or more of the clamps 28 may be severed during the construction of a lateral branch is of no consequence.

As shown in FIG. 5, each clamp 28 has a collar 62 with a protruding portion defining a duct 64 for the cabling 12 to pass through. As with the duct 44 in the coupling clamp 26, the duct 64 in the casing clamp 28 preserves the positive orientation of the cabling 12 and prevents the cabling 12 from shifting.

In the FIG. 5 view, the casing clamp 28 encircles the exterior wall 66 of a casing section 20 where a lateral branch is planned. In this example, a non-colliding region lies in a segment 68 bounded by arrows Z and Z'. A non-colliding region refers to that portion of the casing 10 in which a window in the casing 20 may be milled and a lateral well drilled without severing the cabling 12. Thus, in this example, a window may be milled in the casing 12 in any azimuth between arrows Z and Z' without severing the cabling 12 attached to the exterior wall 66 of the casing segment 20.

The orientation of the cabling 12 at the clamp points on the casing 10 may also be recorded during casing 10 string construction. The cabling's 12 orientation may be known with respect to one or more couplings 22 and/or 24. Additionally, the cabling's 12 orientation may be known with respect to adjacent clamp points on the casing 10. Thus, the path of the cabling 12 may be traced by the cabling's 12 recorded orientation at each clamp 26 and/or 28. Therefore, after the casing 10 is placed in the wellbore 14 and the cabling's 12 azimuth at the indexing couplings 22 and/or intermediate couplings 24 are determined, the azimuth of the cabling 12 at any point along its path may also be determined.

Figure 6:
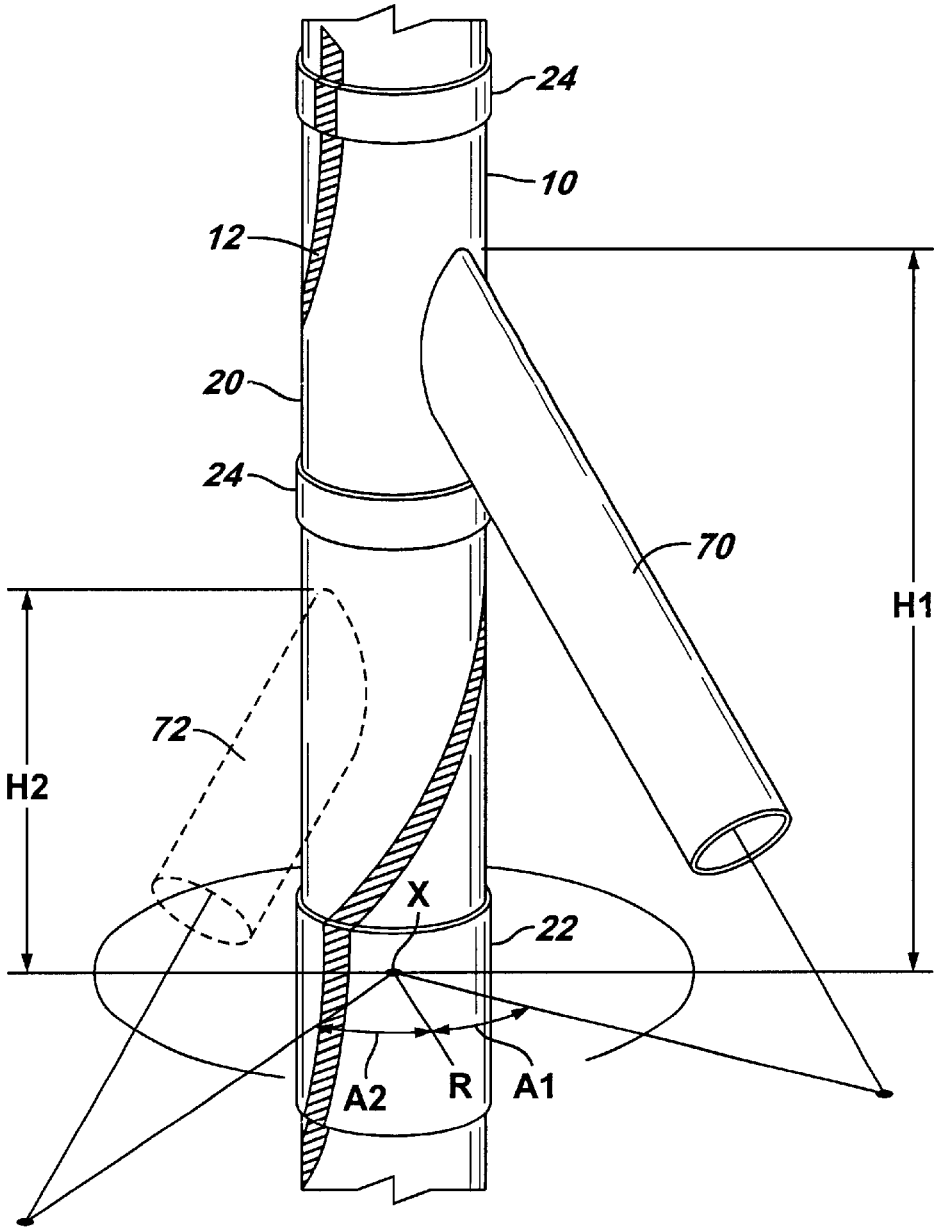
FIG. 6 illustrates a portion of the casing string having a lateral branch that did not sever the cabling during milling and drilling operations.

As shown in FIG. 6, the optimal location for drilling one or more lateral branches 70 in the casing 10 without cutting the cabling 12 may be readily determined. As previously described, a logging sonde may be used to determine the azimuthal orientation of an internal marker of the indexing coupling 22 such as the orienting slot 34. Because, as described, the orientation and turn of the cabling 12 are known with respect to the marker 34, the azimuthal orientation of the cabling 12 along the length of the casing segment 20 may also be determined. Thus, a depth and azimuth for drilling a lateral branch that will not sever the cabling 12 may be determined.

For example, in FIG. 6 the indexing coupling 22 is at a depth "X". The line "R" indicates the position of the internal marker 34. Because the cabling's orientation and curve angle are known with respect to the marker 34, the angles of departure from R, A1 and A2, may be determined. Optimum offsets H1 and H2 correspond to the departure angles A1 and A2 respectively. The optimum offsets H1 and H2 represent the heights with respect to the depth X at which a window may be milled through the casing 10 to avoid collision with the cabling 12. In this example, a lateral branch 70 has been drilled at offset H1. However, as indicated by the phantom lateral branch 72, a lateral branch may also be drilled at offset H2. Thus, as shown in FIG. 6, a lateral branch may be drilled in substantially any azimuth in a length of casing 10 proximate to an indexing coupling 22. That is, depending on desired departure angle, one of plural different offsets is selected for performing the milling.

Similar techniques can be used to avoid damaging other structures (other than cabling 12) outside the casing 10. The other structures are fixed in a known orientation with respect to an indexing coupling. Thus, care can be taken to avoid these structures when milling a window in the casing 10.

The above has described a method and system for avoiding damage of cabling or other structures outside a casing when milling a window in casing. A similar method and system can be used to avoid damage of cabling and other structures in any other operation that involves cutting an opening through the casing 10.

For example, it may be desirable to drill a small opening in the casing to make measurements of the surrounding formation. To do so, a drilling tool is lowered into the well. A drilling bit is extended from the drilling tool, with the drilling bit drilling perpendicularly to the casing inner surface. The hole is drilled through the casing 10, the surrounding cement, and into the surrounding formation. Pumping is then started to flow formation fluid into the wellbore so that a sample of the formation can be taken and measurements made of the sample. After the sampling has been performed, the hole drilled into the casing is plugged and the drilling tool removed to the well surface.

Another application is perforating through the casing. Perforations are made in the casing for hydrocarbon to flow through. Thus, when making perforations it is desirable to avoid damaging structures behind the casing.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for use in a wellbore comprising:

determining a location of a structure behind a casing in the wellbore with respect to a first element inside the casing;

identifying a position on the casing that is away from an area proximate the location of the structure; and making an opening with a rotary cutter through the casing at the position to avoid damaging the structure.

2. The method of claim 1, wherein determining the location of the structure includes determining the location of a cabling behind said casing.

3. The method of claim 2, further comprising determining a path of the cabling behind said casing.

4. The method of claim 3, wherein determining the path comprises determining a generally helical path.

5. The method of claim 1, wherein identifying said position comprises determining an angle of departure from said first element.

6. The method of claim 5, further comprising determining an offset on said casing from a depth of the first element, the offset being a depth at which the opening can be cut at the angle of departure from the first element while avoiding the structure.

7. A method for use in a wellbore comprising:

determining a location of a structure behind a casing in the wellbore with respect to a first element inside the casing;

identifying a position on the casing that is away from an area proximate the location of the structure;

cutting an opening through the casing at the position to avoid damaging the structure; and milling a window through said casing.

8. A method for use in a wellbore comprising:

determining a location of a structure behind a casing in the wellbore with respect to a first element inside the casing;

identifying a position on the casing that is away from an area proximate the location of the structure;

cutting an opening through the casing at the position to avoid damaging the structure; and connecting segments of the casing with an indexing coupling, the indexing coupling comprising the first element.

9. The method of claim 8, further comprising attaching the structure to the indexing coupling using a clamp, the clamp having a predetermined azimuthal orientation with respect to the indexing coupling.

10. A method of installing a structure behind a casing comprising:

assembling a casing having two sections joined by an indexing coupling; and positioning the structure on an exterior surface of said casing with a known orientation with respect to said indexing coupling.

11. The method of claim 10, further comprising clamping said structure to said indexing coupling.

12. The method of claim 10, further comprising clamping said structure to said exterior surface of said casing.

13. The method of claim 10, wherein the structure comprises cabling, and wherein positioning said structure includes positioning said cabling along a generally helical path.

14. The method of claim 13, further comprising lowering said assembled casing into a wellbore without consideration of the orientation of said assembled casing about a long axis of said assembled casing.

15. A method of installing a structure behind a casing comprising:

assembling a casing having two sections joined by an indexing coupling;

positioning a cabling on an exterior surface of said casing with a known orientation with respect to said indexing coupling;

positioning said cabling along a generally helical path; and determining a first azimuth of said cabling, said first azimuth being at the depth of said indexing coupling.

16. The method of claim 15, further comprising determining a second azimuth of said structure with reference to said first azimuth, said second azimuth being at a second depth on said casing other than the depth of said structure at said first azimuth, said second azimuth specifying a direction that points away from the cabling at the second depth.

17. The method of claim 15, further comprising identifying a location on said casing that is away from said first azimuth to cut an opening in said casing without interfering with said structure.

18. A system for use in a wellbore comprising:

a casing;

a reference on said casing;

a structure positioned on an outer surface of said casing in a known orientation with respect to said reference; and one or more locations on said casing away from said structure where an opening may be cut with a tool having a rotary cutter without damaging said structure.

19. The system of claim 18, wherein said structure comprises cabling arranged in a generally helical path along the outer surface of the casing.

20. The system of claim 19, wherein said cabling is arranged in said generally helical path along substantially an entire length of said casing.

21. The system of claim 19, wherein said cabling is arranged in said generally helical path along a portion of said casing.

22. The system of claim 18, further comprising a clamp to secure said structure to said casing.

23. The system of claim 18, further comprising a tool adapted to detect an azimuthal orientation of the reference.

24. A system for use in a wellbore comprising:

a casing;

a reference on said casing;

a structure positioned on an outer surface of said casing in a known orientation with respect to said reference;

one or more locations on said casing away from said structure where an opening may be cut without damaging said structure; and an indexing coupling to connect segments of the casing, wherein said reference includes an orienting slot on said indexing coupling.

25. A system for use in a wellbore comprising:

a casing;

a reference on said casing;

a structure positioned on an outer surface of said casing in a known orientation with respect to said reference; and one or more locations on said casing away from said structure where an opening may be cut with a milling tool without damaging said structure.

* * * * *

UNITED STATES PATENT AND TRADEMARK OFFICE

CERTIFICATE OF CORRECTION

PATENT NO. : 6,725,927 B2
DATED : April 27, 2004
INVENTOR(S) : Herve Ohmer

It is certified that error appears in the above-identified patent and that said Letters Patent is hereby corrected as shown below:

Title page,
Item [74], *Attorney, Agent, or Firm*, delete "Echds" and insert -- Echols --.

Signed and Sealed this

Seventh Day of September, 2004

JON W. DUDAS
*Director of the United States Patent and Trademark Office*